US006666361B1

(12) United States Patent
Lin

(10) Patent No.: US 6,666,361 B1
(45) Date of Patent: Dec. 23, 2003

(54) BABY-CARRYING BAG

(76) Inventor: Chung Hsun Lin, No. 137, Minchiuan Rd., Dahu Tsuen, Hunei Shiang, Kaohsiung (TW)

( * ) Notice: Subject to any disclaimer, the term of this patent is extended or adjusted under 35 U.S.C. 154(b) by 0 days.

(21) Appl. No.: 10/252,558

(22) Filed: Sep. 24, 2002

(51) Int. Cl.[7] ..... A61G 1/00
(52) U.S. Cl. ..... 224/160; 224/259; 224/627
(58) Field of Search ..... 224/160, 161, 224/259, 578, 579, 627

(56) References Cited

U.S. PATENT DOCUMENTS 2,855,133 A * 10/1958 Mullin ..... 224/159
3,481,517 A * 12/1969 Aukerman ..... 224/160
4,949,888 A * 8/1990 May ..... 224/627
5,454,498 A * 10/1995 Dunn et al. ..... 224/160
5,950,886 A * 9/1999 Maupin ..... 224/160
5,996,871 A * 12/1999 Maeng ..... 224/627

* cited by examiner

*Primary Examiner*—Gary E. Elkins

(57) ABSTRACT

A baby-carrying bag includes a bag portion formed from a front piece and a rear piece continuously extended upward from a bottom of the front piece, and two shoulder straps symmetrically provided behind the bag portion to extend between upper and lower edges of the rear pieces. The two shoulder straps are correspondingly provided along inner longitudinal edges with a two-part fastening means. When two complementary parts of the two-part fastening means are closed, the two shoulder straps are combined into one piece. A user may select to use either a combined strap or two separated straps to carry a baby in the most suitable and comfortable manner.

7 Claims, 10 Drawing Sheets

BABY-CARRYING BAG

BACKGROUND OF THE INVENTION

The present invention relates to a baby-carrying bag, and more particularly to a baby-carrying bag having two combinable shoulder straps that may be combined into one piece or maintained in two separated pieces according to a user's preference, in order to enable carrying of a baby with the bag in different and comfortable manners.

A baby-carrying bag is normally positioned in front of a user's chest or behind the user's back for carrying a baby therein. FIG. 1 is a perspective view of a conventional baby-carrying bag including a bag portion 1 consisting of integrally formed back support 11 and buttock support 12, and two shoulder straps 2 provided at two lateral sides of the bag portion 1. Upper ends of the two shoulder straps 2 are connected to two upper outer ends of the back support 11, and lower ends of the two shoulder straps 2 are crossed before being connected to two lateral sides of a bottom of the buttock support 12. To ensure safe carry of a baby with the bag portion 1, an adjustable side belt 13 is provided to extend across an outmost edge of the buttock support 12 with two ends of the side belt 13 separately connected to two lower outer ends of the back support 11 or two upper outer ends of the buttock support 12.

Please refer to FIG. 2 that shows the manner of using the conventional baby-carrying bag of FIG. 1 to carry a baby. As shown, the two shoulder straps 2 are usually positioned on a user's two shoulders with the bag portion 1 located in front of or behind the user, and the baby is seated in the bag portion 1 with two legs extended from spaces between the buttock support 12 and the side belt 13 while the back support 11 supports the baby's back.

It can be clearly seen the conventional baby-carrying bag having the above-described structure does not safely and comfortably enclose the carried baby. Moreover, the shoulder straps 2 have completely limited the user to carry the baby in only two manners, that is, to carry the baby either in front of or behind the user with the shoulder straps 2 generally parallelly extended over the user's two shoulders, even the user might not feel comfortable to carry the baby in these manners.

It is therefore tried by the inventor to develop a baby-carrying bag having two combinable shoulder straps that may be combined into one piece or maintained in two separated pieces according to a user's preference, in order to carry a baby with the bag in a most comfortable manner.

SUMMARY OF THE INVENTION

A primary object of the present invention is to provide a baby-carrying bag that includes two combinable shoulder straps. The shoulder straps may be combined into one piece or maintained in two separated pieces according to a user's preference. And, the user may handle the combined or the separated shoulder straps in different manners, so as to carry a baby with the bag in a most comfortable posture.

To achieve the above and other objects, the baby-carrying bag of the present invention mainly includes a bag portion formed from a front piece and a rear piece continuously extended upward from a bottom of the front piece, and two shoulder straps symmetrically provided behind the bag portion to extend between upper and lower edges of the rear pieces. The two shoulder straps are correspondingly provided along inner edges with a two-part fastening means.

When the two parts of the fastening means are closed, the two shoulder straps are combined into one piece. A user may select to use either a combined strap or two separated straps to carry a baby in the most suitable and comfortable manner.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
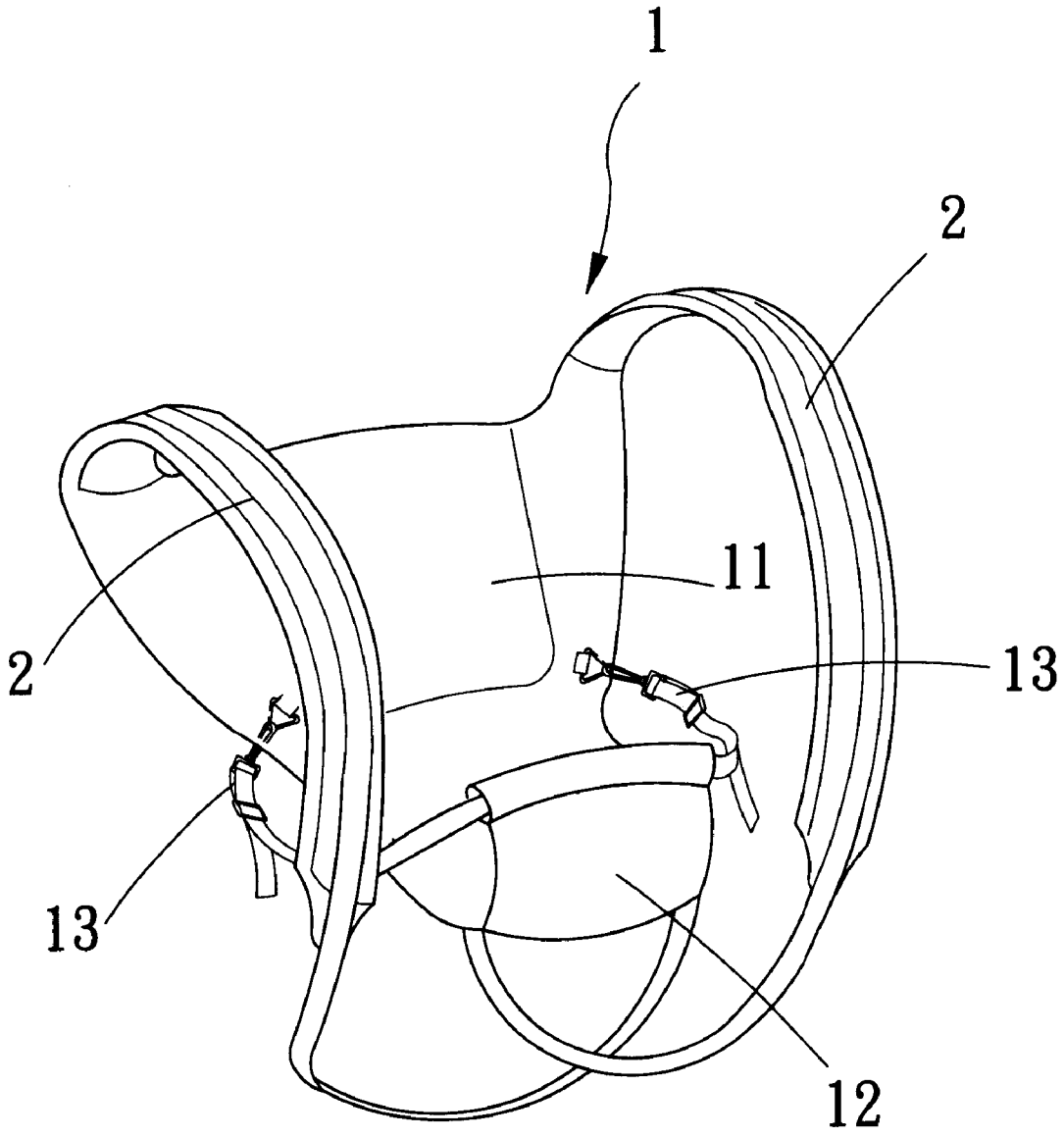
(PRIOR ART) Fig. 1
FIG. 1 is a perspective view of a conventional baby-carrying bag.
Figure 2:
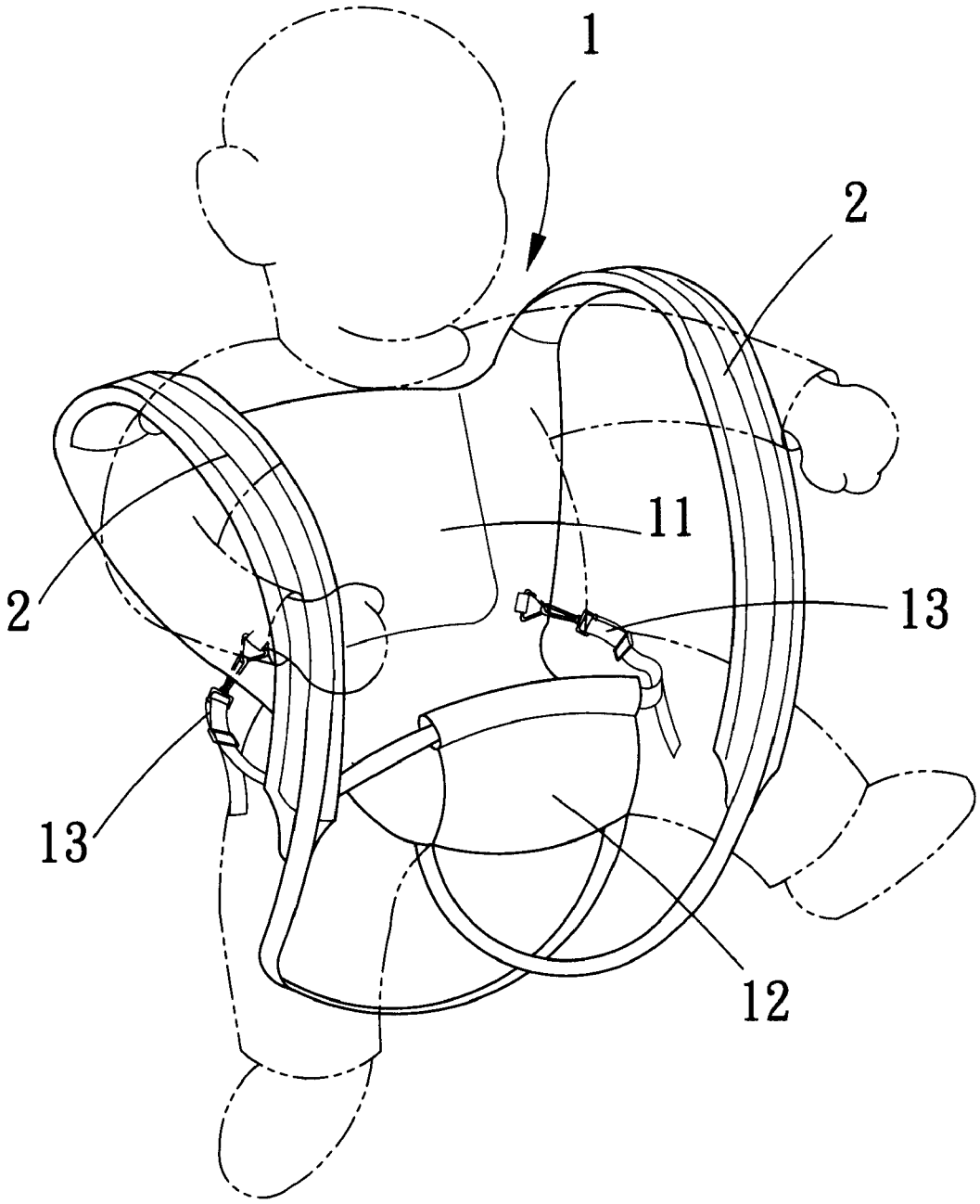
(PRIOR ART) Fig. 2
FIG. 2 shows the manner of using the conventional baby-carrying bag of FIG. 1 to carry a baby.
Figure 3:
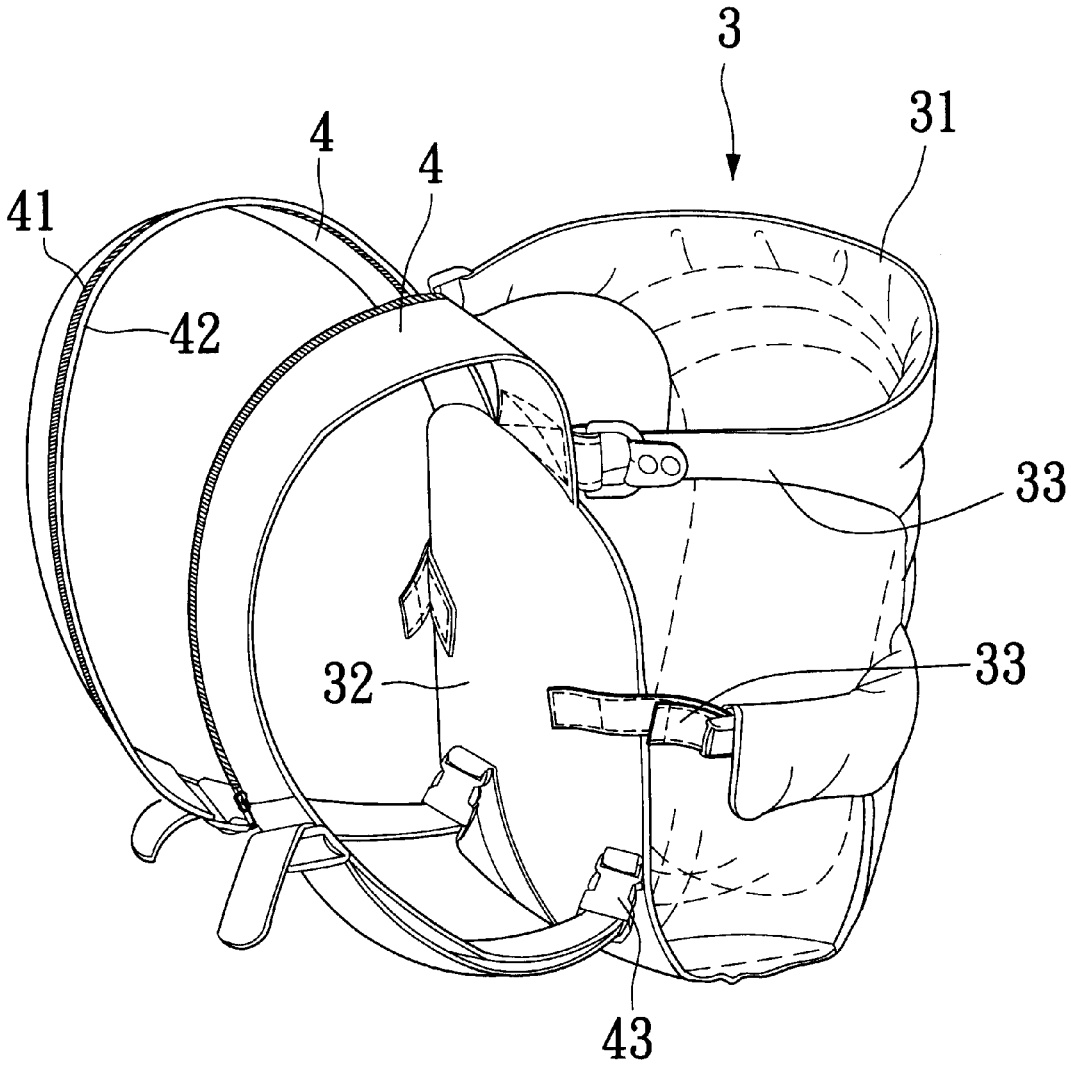
FIG. 3 is a perspective view of a baby-carrying bag according to the present invention with two combinable shoulder straps thereof in a separated state.

Please refer to FIG. 3 that is a perspective view of a baby-carrying bag according to the present invention. As shown, the baby-carrying bag includes a bag portion 3 and two shoulder straps 4.

The bag portion 3 includes a front piece 31 and a rear piece 32 that are continuously formed to provide a substantially U-shaped bag. Upper and middle areas of the front piece 31 are partially extended from two lateral edges to provide two pairs of side belts 33. The side belts 33 are connected to the rear piece 32 via length-adjustable connecting means. Since the adjustable side belt 33 is a known art, it is not discussed in details herein.

Figure 4:
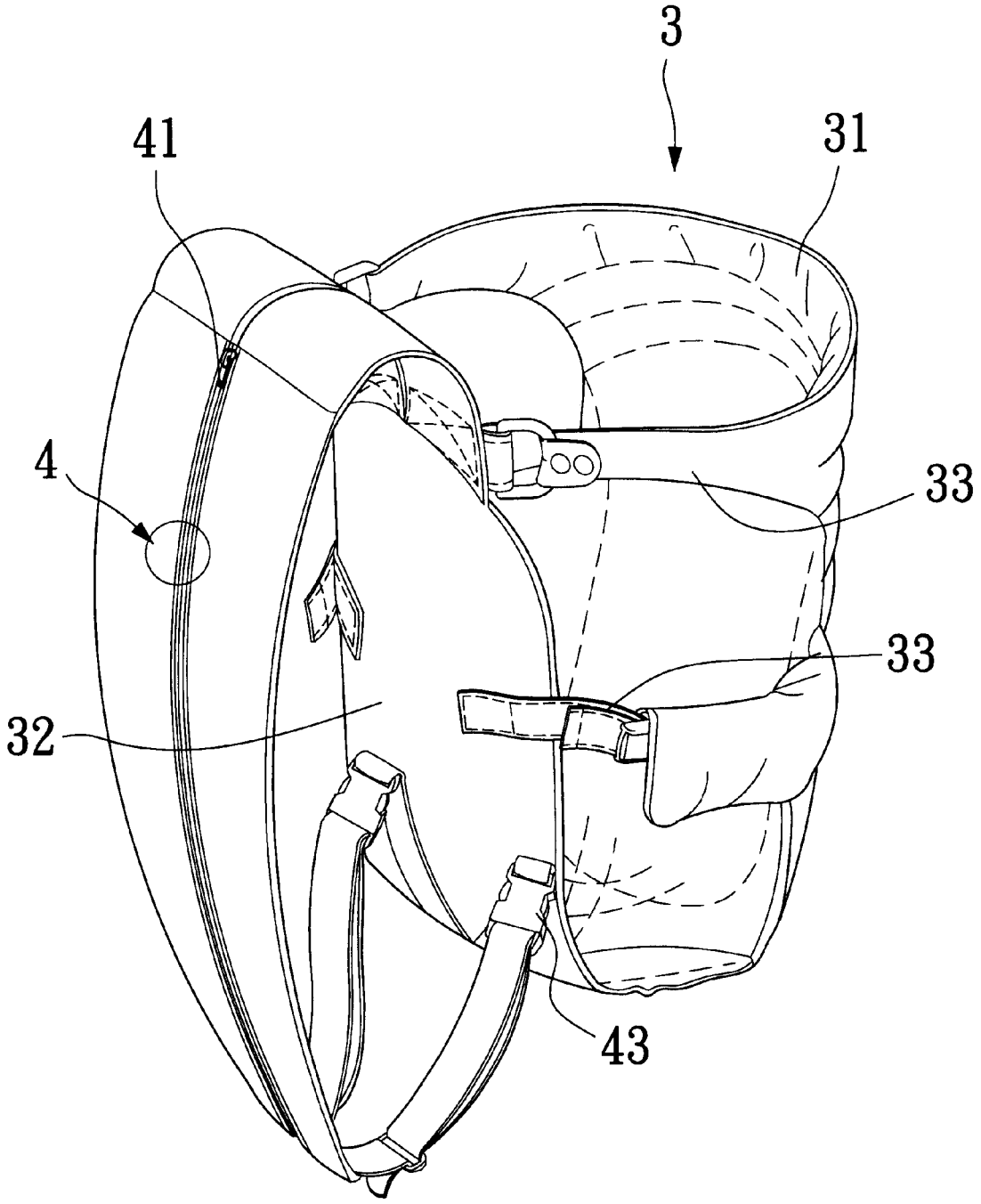
FIG. 4 is another perspective view of the baby-carrying bag of the present invention with the two combinable shoulder straps in a combined state.
Figure 5:
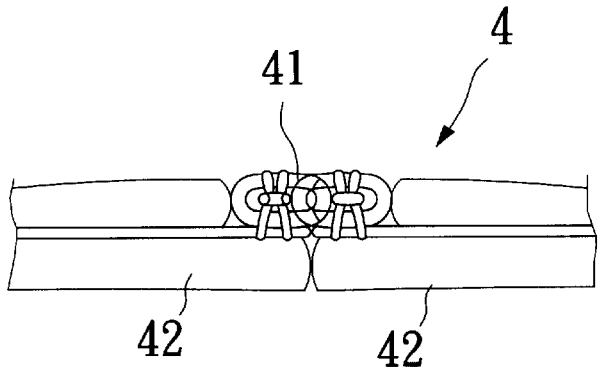
FIG. 5 is a fragmentary cross-sectional view of the shoulder straps of FIG. 4.
Figure 6:
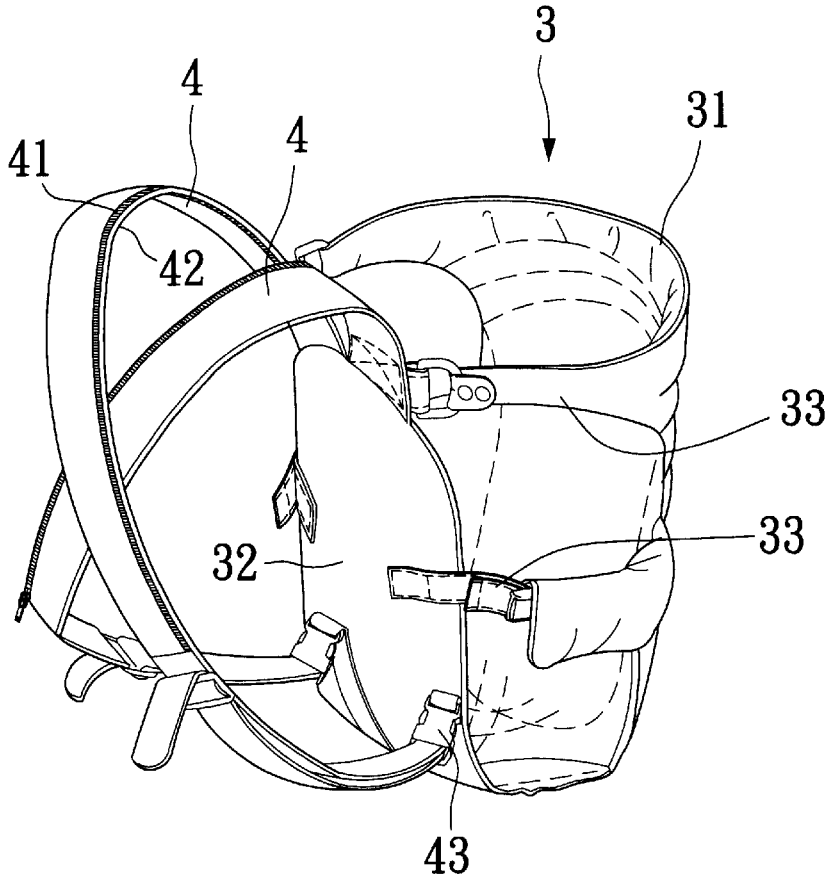
FIG. 6 is a further perspective view of the baby-carrying bag of the present invention with the two combinable shoulder straps in a separated and intersected state.

The two shoulder straps 4 are symmetrically provided behind the bag portion 1 to separately extend between an upper and a lower edge of the rear piece 32. Moreover, a two-part fastening means 41, such as a zipper, a magic tape consisting of a hook tape and a loop tape, a tongue-and-groove joint, etc., is provided along inner longitudinal edges of the two shoulder straps 4. By closing the two-part fastening means 41, the two shoulder straps 4 may be combined into one strap, as shown in FIG. 4. The two shoulder straps 4 are provided along areas behind the two-part fastening means 41 with two protective pads 42, as shown in FIG. 5, to protectively prevent the fastening means 41 from direct contact with a user's body when the baby-carrying bag presses against the user under the weight of a carried baby and the force of gravity. Two sets of male and female fasteners 43 are correspondingly provided at lower ends of the two shoulder straps 4 and two lower outer ends of the rear piece 32 for detachably and length-adjustably connecting the shoulder straps 4 to the rear piece 32. Since the male and female fasteners 43 are known art, they are not discussed in details herein. With the fasteners 43, the two shoulder straps 4 in a separated state may be intersected as a letter X before being connected at lower ends to the rear piece 32, as shown in FIG. 6.

To carry a baby with the baby-carrying bag of the present invention, simply position the baby in the bag portion 3 with the baby's hands extended from spaces defined between the front and the rear pieces 31, 32 and the upper and the middle side belts 33, and two legs from spaces defined between the middle side belts 33 and the bottom of the front piece 31. The front and the rear pieces 31, 32 and the side belts 33 together provide a considerably large and safe area to enclose the carried baby, and the two upper side belts 33 particularly provide good support to the baby's head and thereby protect the baby's head against overly tipping sideward.

Figure 7:
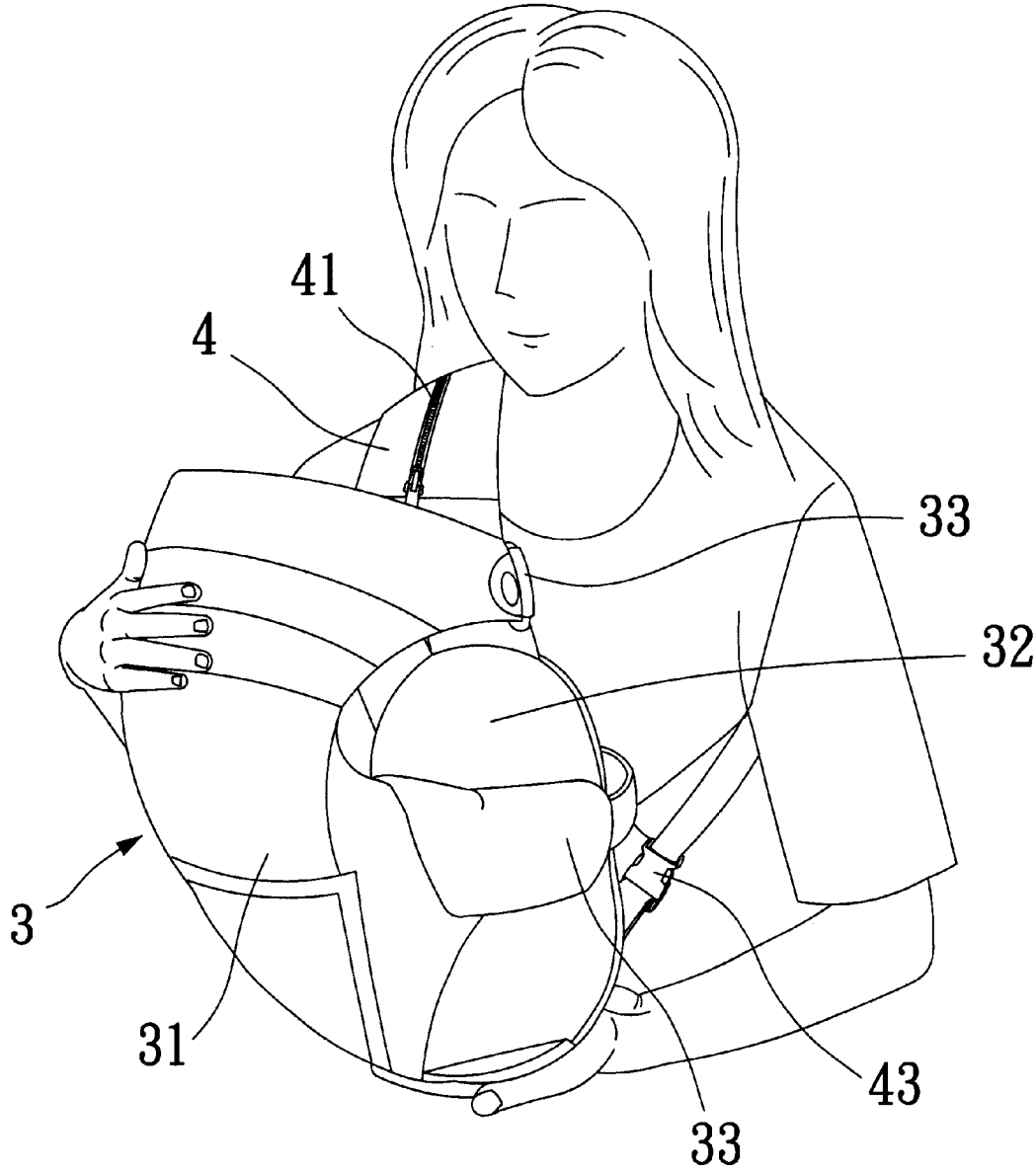
FIG. 7 shows a first manner of using the baby-carrying bag of the present invention to carry a baby.

When the two shoulder straps 4 are combined into one piece by closing the fastening means 41, the user may carry the baby-carrying bag by diagonally extending the combined shoulder straps 4 across one shoulder to position the bag portion 3 in front of her, as shown in FIG. 7. With the baby-carrying bag in this position, the user may further carry the bag portion 3 and the baby therein with two arms to somewhat reduce the loads on the user's shoulder and back.

Figure 8:
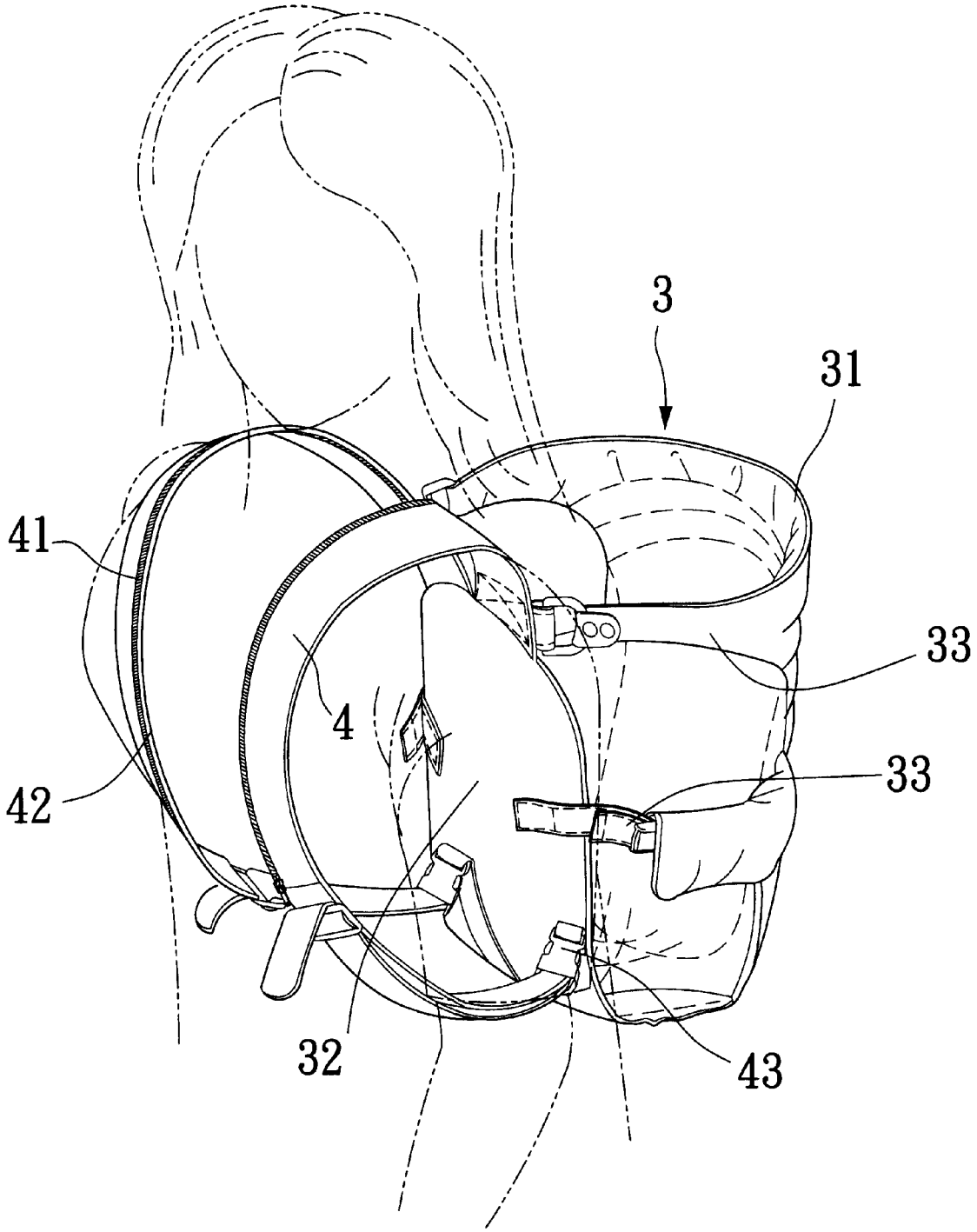
FIG. 8 shows a second manner of using the baby-carrying bag of the present invention to carry a baby.
Figure 9:
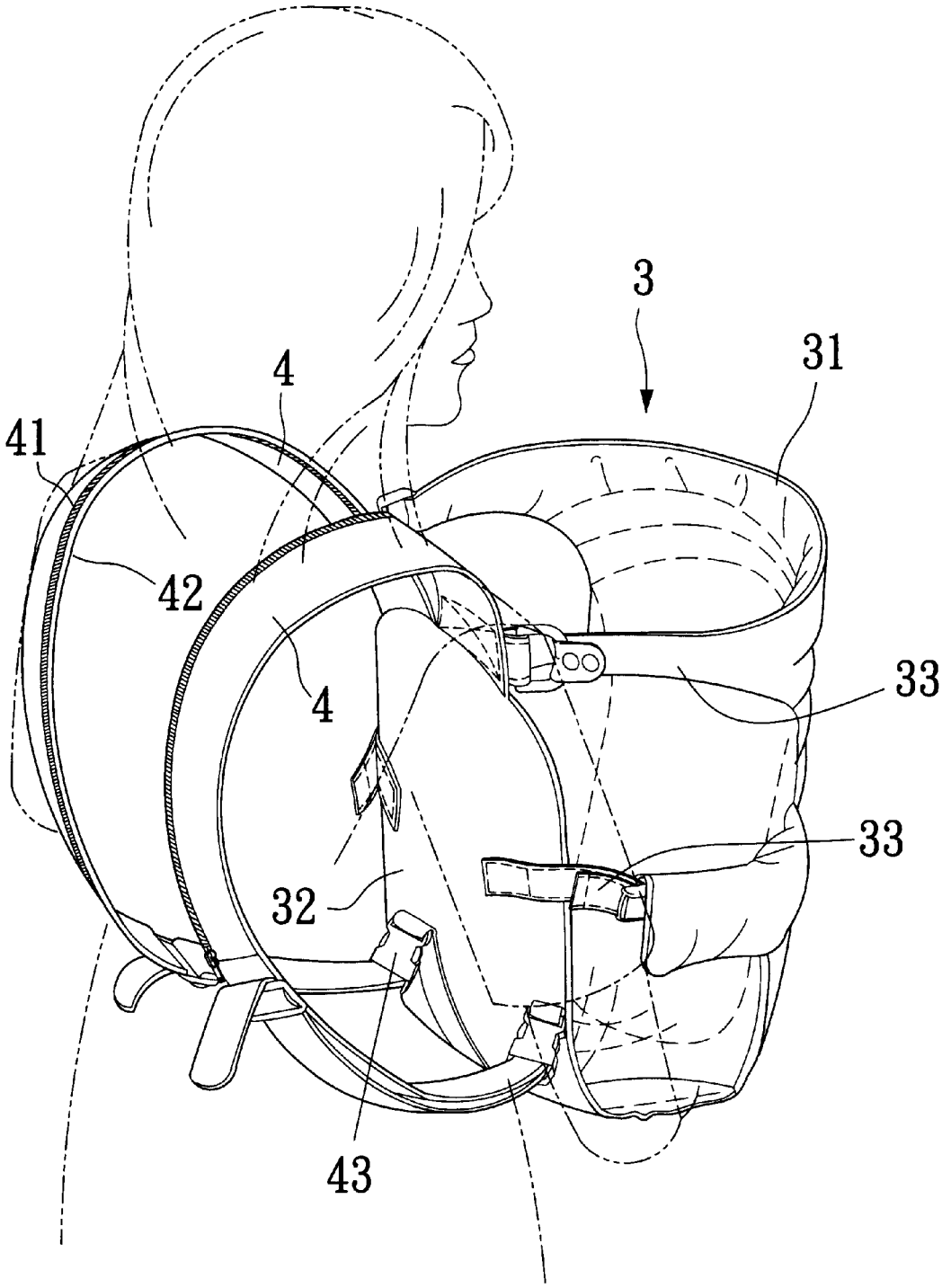
FIG. 9 shows a third manner of using the baby-carrying bag of the present invention to carry a baby.

When the fastening means 41 is opened to separate the two shoulder straps 4 from each other, the user may select from several different manners a most comfortable way to carry the baby. FIGS. 8 and 9 show the two separated shoulder straps 4 are generally parallelly extended across the user's two shoulders to position the bag portion 3 behind and in front of the user's body, respectively, so that the baby's weight is evenly supported by two shoulders at the same time.

Figure 10:
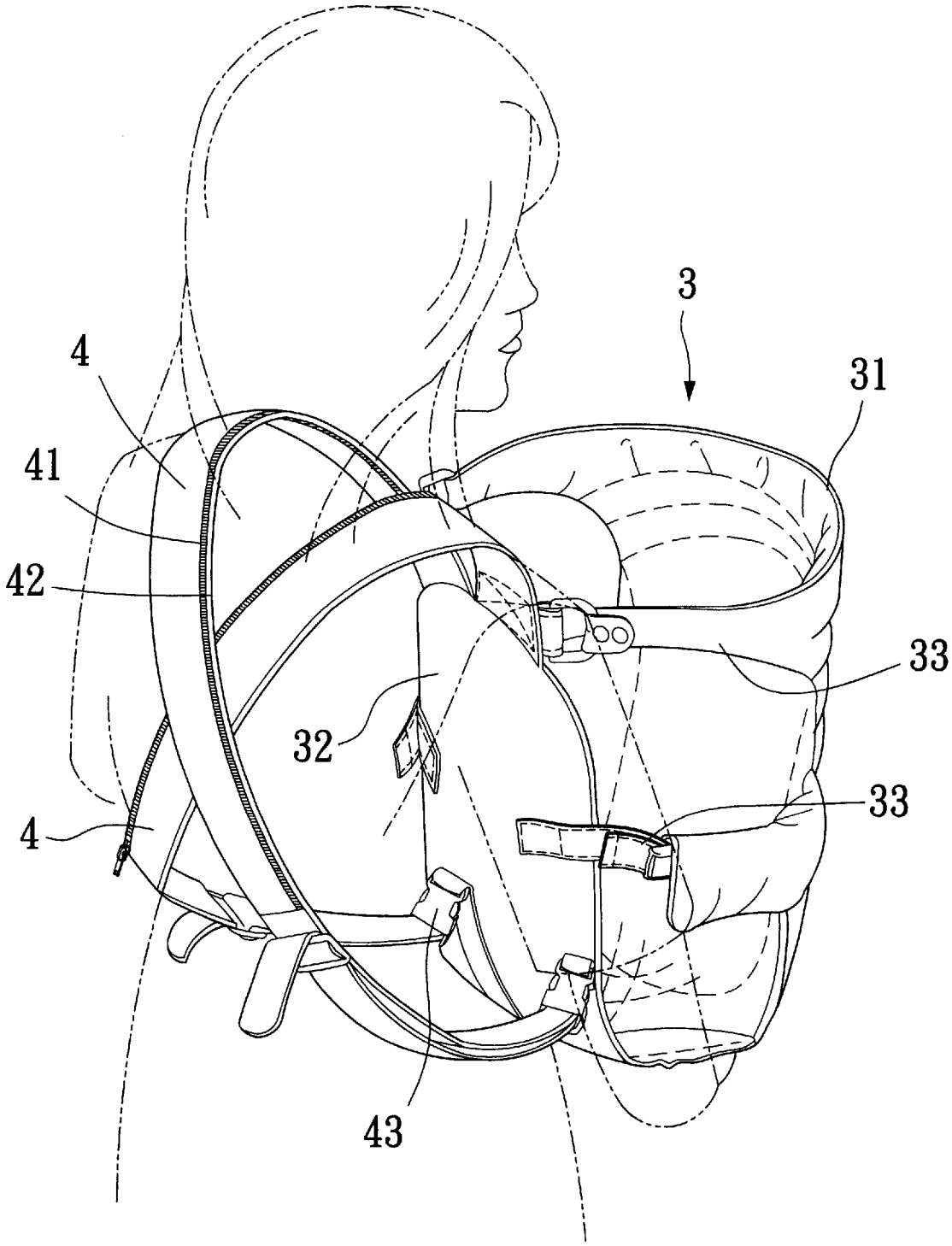
FIG. 10 shows a fourth manner of using the baby-carrying bag of the present invention to carry a baby.
Figure 11:
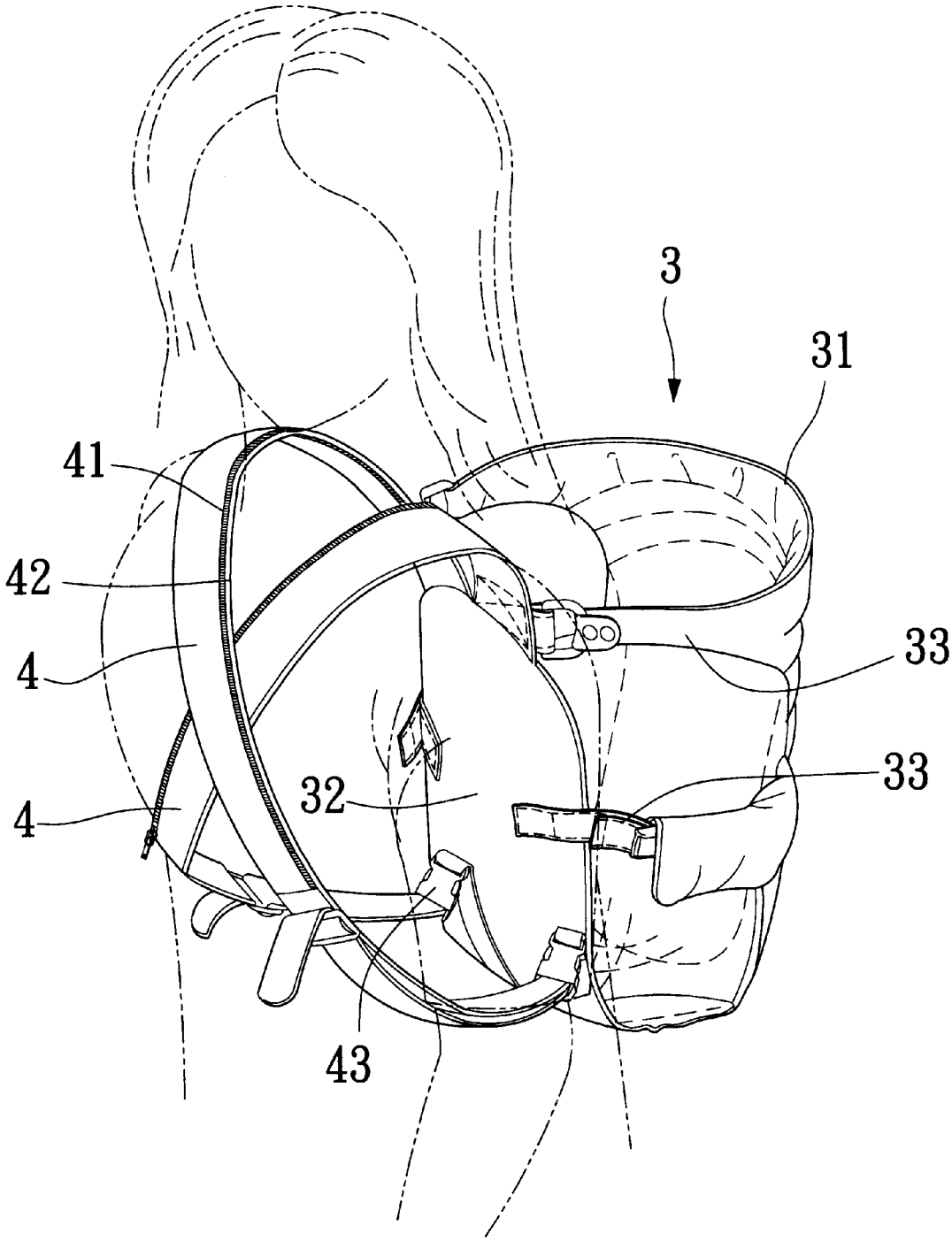
FIG. 11 shows a fifth manner of using the baby-carrying bag of the present invention to carry a baby.

Alternatively, the fastening means 41 may be opened to separate the two shoulder straps 4 from each other, and the male and female fasteners 43 may be unlocked to detach lower ends of the two shoulder straps 4 from the rear piece 32, so that the two shoulder straps 4 may be separately diagonally extended across the user's chest or back to intersect as a letter X before the fasteners 43 are locked to the rear piece 32 again. Similarly, the user may carry the baby-carrying bag of the present invention with the intersected shoulder straps 4 to position the bag portion 3 in front of or behind her, as shown in FIGS. 10 and 11, respectively, so that the baby's weight is evenly supported by the user's two shoulders and chest or back at the same time.

That is, with the two shoulder straps 4 that could be combined into one piece or maintained in two separated pieces by closing or opening the fastening means 41, the baby-carrying bag of the present invention allows the user to select from many different ways the most suitable and comfortable way to carry the baby in the bag portion 3.

What is claimed is:

1. A baby-carrying bag, comprising a bag portion formed from a front piece and a rear piece integrally extended upward from a bottom of said front piece, and two shoulder straps symmetrically located behind said bag portion to extend between upper and lower edges of said rear piece; said baby-carrying bag being characterized in that a two-part fastening means is provided along inner longitudinal edges of said two shoulder straps, whereby said two shoulder straps may be combined into one strap by closing two complementary parts of said two-part fastening means or separated from each other by opening said fastening means for a user to handle said shoulder straps according to his or her preference to carry the baby-carrying bag in a most suitable and comfortable manner.

2. The baby-carrying bag as claimed in claim 1, wherein said front and said rear piece together form a generally U-shaped bag portion, and upper and middle areas of said front piece being partially extended from two lateral edges to provide two pairs of side belts which are connected to said rear piece via length adjustable connecting means, such that a baby carried with said baby-carrying bag is safely enclosed in said bag portion with hands and legs extended through spaces between said upper and said middle side belts, and said middle side belts and the bottom of said front piece, respectively.

3. The baby-carrying bag as claimed in claim 1, wherein said shoulder straps and said rear piece are provided at lower ends and two lower outer ends, respectively, with two sets of male and female fasteners, such that said two shoulder straps may be detachably and length-adjustably connected at lower ends to said rear piece as two generally parallel straps or two diagonally intersected straps.

4. The baby-carrying bag as claimed in claim 1, wherein said fastening means for combining said two shoulder straps into one piece is a zipper.

5. The baby-carrying bag as claimed in claim 1, wherein said fastening means for combining said two shoulder straps into one piece is a magic tape consisting of a hook tape and a loop tape.

6. The baby-carrying bag as claimed in claim 1, wherein said fastening means for combining said two shoulder straps into one piece is a tongue-and-groove joint.

7. The baby-carrying bag as claimed in claim 1, wherein said two shoulder straps are provided at areas along said inner longitudinal edges behind said fastening means with two protective pads to prevent said fastening means from direct contact with a user's body, so that the user may comfortably carry said baby-carrying bag.

* * * * *